US007798328B2

(12) United States Patent
Hession

(10) Patent No.: US 7,798,328 B2
(45) Date of Patent: Sep. 21, 2010

(54) INSERT FOR SLEEVE-AND-INSERT TYPE PACKAGE

(75) Inventor: Christopher J. Hession, Knightdale, NC (US)

(73) Assignee: MeadWestvaco Corporation, Richmond, VA (US)

( * ) Notice: Subject to any disclaimer, the term of this patent is extended or adjusted under 35 U.S.C. 154(b) by 3 days.

(21) Appl. No.: 11/754,154

(22) Filed: May 25, 2007

(65) Prior Publication Data

US 2008/0202970 A1 Aug. 28, 2008

Related U.S. Application Data

(60) Provisional application No. 60/803,301, filed on May 26, 2006.

(51) Int. Cl.
*B65D 83/04* (2006.01)

(52) U.S. Cl. ..... 206/531; 206/539; 229/125.125

(58) Field of Classification Search ..... 206/470, 206/531, 532, 534.1, 534.2, 536, 538, 539; 229/125.125; 220/345.1, 345.2
See application file for complete search history.

(56) References Cited

U.S. PATENT DOCUMENTS

| | | | | |
|---|---|---|---|---|
| 3,137,435 | A | 6/1964 | Meyers | |
| 3,215,332 | A | 11/1965 | Bess | |
| 3,332,600 | A | 7/1967 | Guernsey | |
| 3,381,808 | A | 5/1968 | McGraw, II | |
| 3,659,706 | A * | 5/1972 | Serrell | 206/539 |
| 3,888,350 | A | 6/1975 | Horvath | |
| 3,941,248 | A * | 3/1976 | Moser et al. | 206/531 |
| 3,987,891 | A | 10/1976 | Horvath | |
| 4,007,828 | A | 2/1977 | Mayled | |
| 4,101,761 | A | 7/1978 | Merryman | |
| 4,113,098 | A | 9/1978 | Howard | |
| 4,126,224 | A | 11/1978 | Laauwe et al. | |
| 4,154,113 | A | 5/1979 | Engeler | |
| 4,192,422 | A | 3/1980 | Kotyuk | |
| 4,340,141 | A | 7/1982 | Fischer | |
| 4,364,488 | A | 12/1982 | Anjou | |
| 4,401,210 | A | 8/1983 | Anjou | |
| 4,454,704 | A | 6/1984 | Ullman | |
| 4,623,062 | A * | 11/1986 | Chase et al. | 206/45.28 |
| 4,817,819 | A | 4/1989 | Kelly | |
| 4,889,236 | A | 12/1989 | Bartell et al. | |
| 4,940,016 | A | 7/1990 | Heath | |
| 5,115,416 | A | 5/1992 | Gehlbach et al. | |
| 5,275,291 | A | 1/1994 | Sledge | |
| 5,310,060 | A * | 5/1994 | Bitner et al. | 206/532 |
| 5,549,204 | A * | 8/1996 | Toren | 206/539 |
| RE35,445 | E | 2/1997 | Pora | |
| 5,799,675 | A | 9/1998 | Gunderman et al. | |
| 5,873,466 | A * | 2/1999 | Hulick | 206/531 |
| 5,954,202 | A | 9/1999 | Mellon | |
| 5,954,204 | A | 9/1999 | Grabowski | |

(Continued)

FOREIGN PATENT DOCUMENTS

| | | |
|---|---|---|
| DE | 3440853 | 5/1985 |
| DE | 29921100 U1 | 3/2000 |
| DE | 20105928 U1 | 6/2001 |
| EP | 1002744 A1 | 5/2000 |
| EP | 1293436 B1 | 8/2005 |

(Continued)

*Primary Examiner*—Mickey Yu
*Assistant Examiner*—Sharon M Prange
(74) *Attorney, Agent, or Firm*—MWV Intellectual Property Group

(57) ABSTRACT

An improved insert card is provided. The various embodiments include improved hinges, locking tabs, ribs, detachable base panel with center bar, grips, fold-resisting abutments, and fold-over panels.

20 Claims, 5 Drawing Sheets

U.S. PATENT DOCUMENTS

| | | | | |
|---|---|---|---|---|
| 6,024,222 | A * | 2/2000 | Friberg et al. | 206/531 |
| 6,047,829 | A | 4/2000 | Johnstone et al. | |
| 6,082,544 | A | 7/2000 | Romick | |
| 6,112,978 | A | 9/2000 | Barr et al. | |
| 6,230,893 | B1 | 5/2001 | Karow | |
| 6,349,831 | B1 | 2/2002 | Buss | |
| 6,412,636 | B1 | 7/2002 | Jones et al. | |
| 6,491,211 | B1 | 12/2002 | Evans et al. | |
| 6,752,272 | B2 | 6/2004 | Jones et al. | |
| 6,874,636 | B2 * | 4/2005 | Paliotta et al. | 206/531 |
| 7,389,875 | B2 * | 6/2008 | Sandberg et al. | 206/531 |
| 2004/0035740 | A1 | 2/2004 | Paliotta et al. | |
| 2004/0050748 | A1 | 3/2004 | Ehrlund | |
| 2004/0188311 | A1 | 9/2004 | Paliotta et al. | |

FOREIGN PATENT DOCUMENTS

| | | | |
|---|---|---|---|
| EP | 1652781 | A2 | 5/2006 |
| FR | 2816916 | A1 | 5/2002 |
| GB | 1325802 | A | 8/1973 |
| WO | WO 01/28865 | A1 | 4/2001 |
| WO | WO 03/097331 | A1 | 11/2003 |
| WO | WO 2004/019854 | A2 | 3/2004 |
| WO | WO 2004103255 | A2 * | 12/2004 |
| WO | WO 2005/051801 | A1 | 6/2005 |
| WO | WO 2006/042181 | A1 | 4/2006 |
| WO | WO 2007/021788 | A1 | 2/2007 |

* cited by examiner

INSERT FOR SLEEVE-AND-INSERT TYPE PACKAGE

CROSS REFERENCE TO RELATED APPLICATIONS

This application claims the benefit of priority of U.S. provisional application Ser. No. 60/803,301 filed on May 26, 2006, which is hereby incorporated by reference in its entirety.

FIELD OF THE INVENTION

This invention relates to sleeve-and-insert type packaging. More particularly, the invention relates to a novel insert for a sleeve-and-insert type package that is suitable for use as an integral blister card or a receiving tray.

BACKGROUND OF THE INVENTION

A sleeve-and-insert type of package is a package wherein a substantially planar member is housed within an enclosure from which it may be partially or fully removed to gain access to items held on one or more surfaces of the planar member. The planar member may be identified by several alternative names including but not limited to an "insert," a "card," an "insert card," a "slide card," and a "sliding element." These terms will be used interchangeably herein.

Sleeve-and-insert type packaging is useful for a variety of purposes; including the sale and distribution of items that may be juxtaposed permanently or temporarily in some manner with respect to the insert. A sleeve-and-insert type of package is particularly useful as a so-called "unit-dose packaging system." In a unit-dose packaging system medicaments such as pills are removably held to the planar member in individual, or unit doses, typically within a blister. In alternative embodiments unit-doses, such as held in syringes, patches, inhalers, pouches, and the like, are mounted to a tray. Unit dose packaging systems are useful as a means for dispensing an individual, or a unit dose of a medicament. Such systems are even more useful when they have the added features of providing resistance to the package being opened by a child, while at the same time facilitating ease of opening, closing and general use by older individuals whose manual dexterity may have decreased with age. These two features are typically referred to as "child-resistant" and "senior-friendly," respectively.

Preventing or inhibiting undesired partial or full removal of the inner slide card from the sleeve/shell is important in helping facilitate resistance to child tampering and use by seniors. In addition, preventing or inhibiting widespread access to the items held by the sliding element is important to child-resistance. Thus, it will be appreciated that it is useful to have a unit dose package with additional novel features that prevent or inhibit the undesired access of items held by the inner card.

Because decreased cost and increased ease of manufacturing are desirable, it will likewise be appreciated that it is beneficial to have a child-resistant and senior-friendly unit dose package that is efficient to operate, is durable and sturdy, and simple to construct, thereby reducing the cost and inefficiencies of manufacture.

SUMMARY OF THE INVENTION

The present invention overcomes the shortcomings of the prior art by providing features that improve the ease of manufacturing, lower the cost of manufacturing, improve the ease of use, and improve the child-resistance features of an individual insert card as well as sleeve-and-insert package as a whole. These features include a monolithically formed slide card, blisters integral to the slide card, blisters integral to the slide card that are detachable, a detachable locking panel attached to the slide card, improved locking elements, features that increase the durability of the locking elements, ribs that improve the strength and durability of the slide card, ribs that improve the strength of the sleeve, and ribs that interfere with unintended access to the blisters such as by a child trying to bite their way through the sleeve and/or slide card.

According to one aspect of the invention, an improved locking panel with at least one reinforcement element to inhibit deformation hingedly extends from the base panel. In another embodiment, at least two locking panels hingedly extend from the base panel. According to a further aspect of the invention two adjacent locking panels are separated from one another, by a cut line or a slot or a similar means for separation. According to an additional aspect of the invention, the base panel has at least one reinforcement elements to inhibit deformation of the base panel. According to still an additional aspect of the invention, the base panel has an arrangement of one or more ribs.

In accordance with another aspect of the invention, the base panel includes a raised grip configured to improve access and withdrawal of the slide card from a sleeve. In accordance with still a further aspect of the invention, either the locking member or the base panel includes a fold-resisting abutment for improving lockability between the sleeve and card. In accordance with still another aspect of the invention, at least one fold-over panel is hingedly connected to the base panel, and either or both of the base panel and fold-over panel has at least one rib. In accordance with one more aspect of the invention, a fold-over panel is hingedly connected to the base panel. There the base panel and fold-over panel have complementary, cooperating ribs for nesting or interlocking the folded panels.

Also taught herein are insert cards comprising a monolithically formed base panel with at least one hingedly attached locking panel that includes at least one engaging edge. There, at least one blister is integrally formed within the base panel to define a blister opening configured to receive an item that is stored by the blister. Other features of the exemplary insert cards include a seal over the blister opening and at least one rib extending from the base panel. In some embodiments the rib is positioned proximate to the perimeter of the base panel but the ribs may be located anywhere on the insert card.

Additional features of some insert cards include an abutment that inhibits a face-contacting relationship between the base panel and locking panel, wherein at least a portion of the perimeter of the abutment is curved. Further, the base panel can include an extended grip portion for easier access once the insert card has been released from the sleeve. In other embodiments, the blisters are detachable for ease of use. In some of those embodiments the blisters are detachable so as to define a center bar that allows the insert card to fully function within the sleeve even after blisters are removed. In still other embodiments, the locking panel is detachable from the base panel.

Further described and taught herein are insert cards that include one or more hingedly attached fold-over cards. In those embodiments the fold-over cards can include features such as ribs, blisters, abutments, posts, and combinations and the like, that interface, interlock, or otherwise cooperate with one or more similar features of the base panel to nest the folded panels, lock the folded panels, or keep the folded panels spaced apart.

In addition to the insert cards described, taught and claimed herein, a packaging system that incorporates the insert cards is described, taught and claimed. The exemplary system includes a releasably lockable sleeve, as taught in previous applications filed by the present applicant, configured to receive an insert card described, taught or claimed herein. Further, the description includes a method of using the insert cards described, taught and claimed herein. Additional embodiments include insert cards wherein the items are not held to the base panel by blisters but by other means for securing, including clips, ties, receiving inserts, tabs, locking posts, tape, hook and loop fasteners, ribs, springs, combinations thereof, and the like.

DETAILED DESCRIPTION OF THE INVENTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

For the purposes of teaching and illustration, and not limitation or restriction, the illustrated embodiments of the present invention reference pharmaceutical products such as medicaments in the form of tablets, pills and the like. It is contemplated that the present invention is not limited to the pharmaceutical-related goods referenced with the illustrated embodiments, but is applicable to any small, delicate, sensitive, or portable item. Accordingly, the present invention can be used with all nature of small and portable items that the user may want to hold and store in a releaseably lockable container and dispense in a regulated manner. Further, the present invention is not limited to the blister packs referenced with the illustrated embodiments, but is applicable to any tray, card, rack, pack, pouch, and the like to which an item of any sort may be held, stored, attached, secured or otherwise associated with the item.

Figure 1:
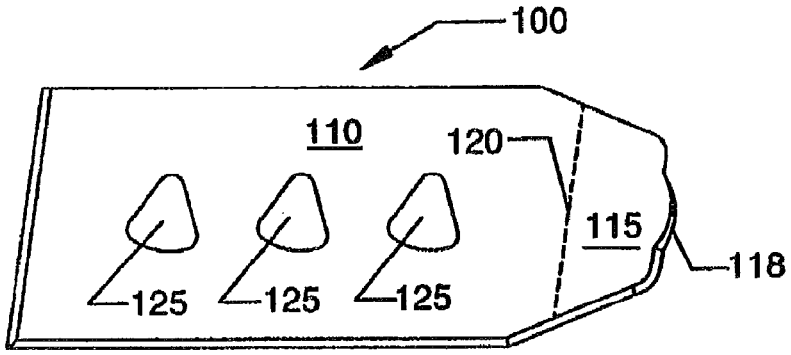
FIG. 1 is a perspective view of an exemplary embodiment of a slide card, according to the present invention.

Referring now to FIG. 1, an exemplary embodiment of a slide card 100 is shown. The slide card 100 is primarily for use with a releaseably lockable sleeve, as taught in one or more prior applications or patents filed by the present applicant, and includes a base panel 110 and a locking panel 115. The locking panel 115 includes an engaging edge 118. The base panel 110 is connected to the locking panel 115 by a hinge 120. The base panel 110 has formed cavities or blisters 125 for receiving an item. In the exemplary embodiment, the blisters 125 are integrally formed with the base panel 110 and a seal, such as a foil or paper substrate, is attached to the base panel 110 to enclose the item within each blister 125. The items are thereby held in place within the blisters 125 until being removed by known methods.

The slide card 100 can be made of any material including paper or plastic, formed by manufacturing processes including thermo-forming or die-pressing. The hinge 120 can be formed in any configuration by forming a fold line, score line, cut line, perforation lines, or any combination thereof, and the like. The locking panel 115 is pivotable about the hinge 120 such that it can engage a locking element in the sleeve, and thereby inhibit undesired removal of the slide card 100 from the sleeve. In the embodiment shown in FIG. 1, the slide card 100 is a thermo-formed plastic blister card used to hold medicaments.

Figure 2:
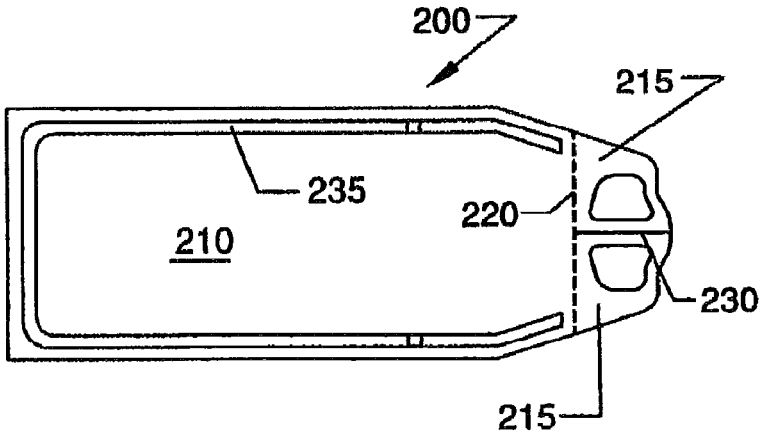
FIG. 2 is a plan view of an exemplary embodiment of a slide card, according to the present invention.
Figure 3:
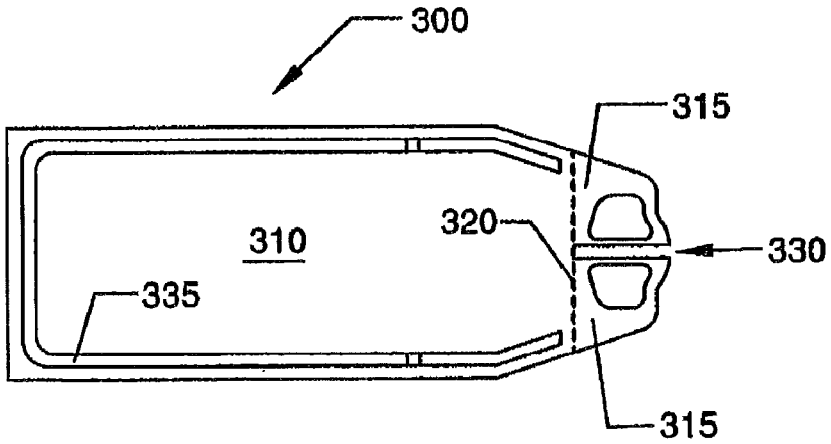
FIG. 3 is a plan view of an exemplary embodiment of a slide card, according to the present invention.
Figure 4:
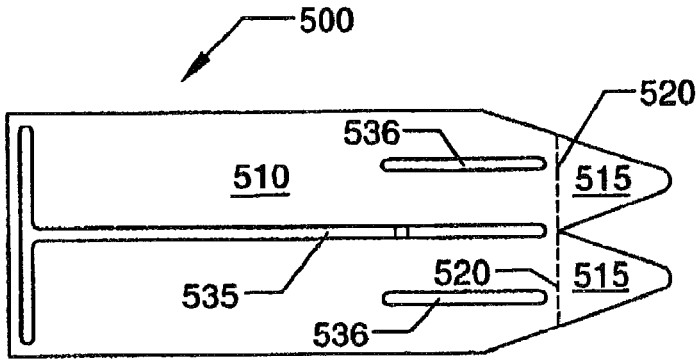
FIG. 4 is a plan view of an exemplary embodiment of a slide card, according to the present invention.

In the exemplary embodiments shown in FIGS. 2-4, the slide cards 200, 300, 500 include multiple locking panels 215, 315, 515, respectively. The locking panels 215 of the slide card 200 are each defined by a hinge 220 and separated from one another by a cut line 230. Similarly, the locking panels 315 are defined by a hinge 320 and separated from one another by a cutout 330. The cutout may also be termed a slot. The illustrated locking panels 515 are triangular shaped and connected to the base panel 510 along respective hinges 520. Alternative embodiments can include locking panels of alternative shape and additional number.

Each of the locking panels 215, 315, 515 on the respective slide cards 200, 300, 500 are independent from one another. Thereby, each of the locking panels independently engages a respective locking element of a related sleeve. Thus, to release the slide card from the sleeve, it is considered that one or more release mechanisms may be used to release the locking panels from their respective locking elements. For example, a single release mechanism may be used that releases each of the locking panels substantially simultaneously. Alternatively, each of the locking panels may have its own release mechanism. It is increasingly difficult to release the slide card from the sleeve as the number of release mechanisms that are required to be substantially simultaneously triggered to release the slide card from the sleeve increases.

Accordingly, increasing the number of release mechanisms that are required to release the slide card improves the child resistance of the package.

Slide cards taught by the present invention may have at least one rib 235, 335, 535. A rib, as taught by the present invention, is a raised member extending from a plane that is the surface of a base panel or the locking panel, or both. Ribs can extend in either direction, that is, upwardly or downwardly with respect to a surface of the panel, or both. The rib or a section of a rib may serve multiple purposes including, but not limited to, providing a barrier to a portion of the base panel (for example, forming a barrier around an item placed on the base panel), providing a barrier to resist application of a perpendicularly applied force (for example, crushing or biting), serving as a gripping structure to facilitate grasping of a base panel or locking member, and serving as structural reinforcement against deformation of the base panel or the locking panel, or both.

Certain embodiments of slide cards include at least one rib. Another advantage of the rib(s) taught herein is the increased rigidity to the slide card. The rib or ribs may be thermoformed or pressed into the slide card, or may be separately attached to the slide card. Referring to FIGS. 2 and 3, a U-shaped rib 235, 335 extends around the perimeter of the base panel 210, 310, respectively.

Figure 5:
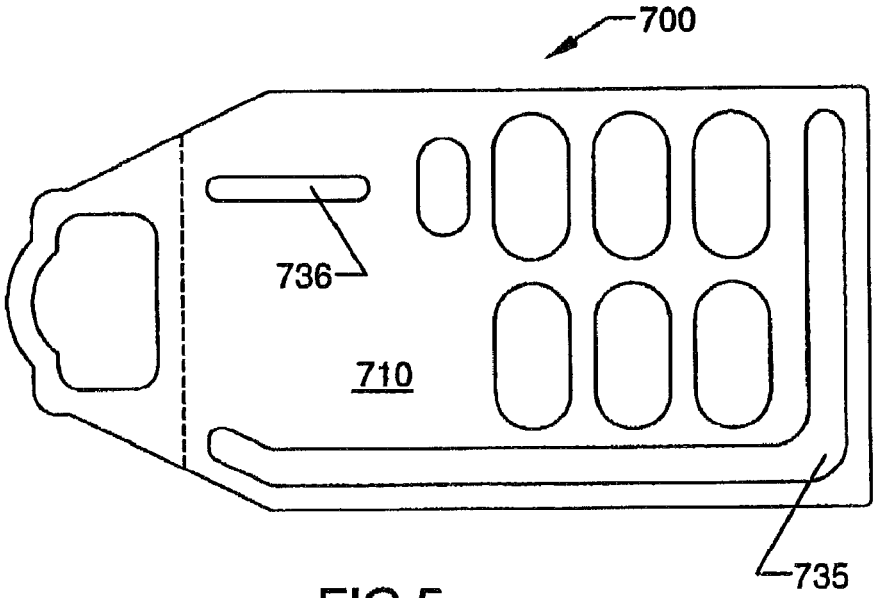
FIG. 5 is a plan view of an exemplary embodiment of a slide card, according to the present invention.

Turning now to FIG. 4, there is shown an alternative embodiment in the form of a T-shaped rib 535 that extends along an edge and longitudinally along the substantial center of the base panel 510. The slide card 500 further includes elongated ribs 536 that substantially align with respective locking panels 515 and are offset from the longitudinal portion of the rib 535. Referring to FIG. 5, an L-shaped rib 735 extends around a portion of the perimeter of the base panel 710. The slide card 700 further includes a longitudinal rib 736 to provide rigidity to a portion of the base panel 710, which is offset from the rib 735. Alternative embodiments (not shown) provide a slide card that includes a series or pattern of ribs which increase the rigidity of areas of the base panel and the locking panel, respectively.

It should be noted that the ribs are not limited to the locations, shapes, arrangements, or patterns described herein. Rather, the locations, shapes, arrangements, or patterns of the ribs are determined in order to increase the rigidity of the slide card, to accommodate the placement of blisters and other features, and provide other beneficial features. For slide cards that are thermoformed, a certain amount of rigidity is helpful to prevent or inhibit the slide card from curling or twisting after being formed. The ribs can be arranged to accommodate a desired blister layout or configuration, such as the layouts described herein. Accordingly, the location of ribs may be adapted to provide rigidity or other features without interfering with or obstructing the other elements of the slide card.

The ribs can be strategically located to provide beneficial features. For example, the ribs can be located to provide a child resistance feature, for example, such that the ribs prohibit biting into the card to access articles in the blisters. The location of each rib can provide additional functional benefits when the slide card is used in combination with a sleeve or outer carton. For example, disposing a rib at an end of the slide card, which corresponds with the open end of a sleeve, provides an end closure to the open end of the sleeve. Thereby, when the slide card is received in the sleeve, the rib protects the slide card and items contained therein from dust, pests, and unintended access. In the embodiments shown herein, the end of the slide card that corresponds to the open end of a sleeve is the end opposite the locking panel.

In certain embodiments, a slide card 100 is designed for being enclosed in a sleeve that includes a catch flap, as taught in previous applications filed by the present applicant. The catch flap is disposed at the open end of the sleeve such that, as the slide card 100 is pulled from the sleeve, the folded locking panel 115, 215, 315, 515, of the slide card engages the catch flap, thereby preventing the slide card from being fully removed from the sleeve. If the slide card is inserted into the sleeve such that the side of the slide card from which the blisters protrude is adjacent to the wall of the sleeve that the catch flap is hingedly connected, the blisters may inadvertently interfere with the removal of the slide card. Specifically, the catch flap may engage one or more of the blisters, thereby preventing the slide card from being removed from the sleeve. In this case, ribs 235, 335, 535, 735 extend the length of the slide card to act as a bridge or as rails to prevent the blisters from engaging the catch flap as the slide card is removed from the sleeve. Here, also, but not necessarily, the rail portion of the ribs has a height that is no less than the height of blisters, allowing the catch flap to slide along the rails and not engage the blisters. The height of the rails and of the blisters is referenced relative to the base panel 210, 310, 510, 710.

Figure 6:
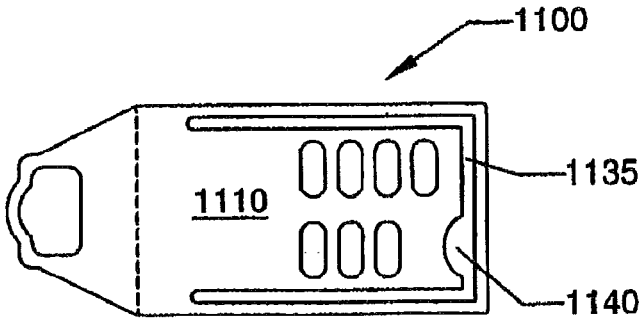
FIG. 6 is a plan view of an exemplary embodiment of a slide card, according to the present invention.
Figure 7:
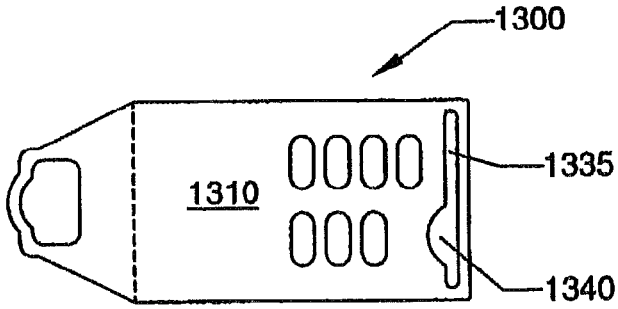
FIG. 7 is a plan view of an exemplary embodiment of a slide card, according to the present invention.

As shown in FIGS. 6 and 7, certain embodiments of slide cards 1100, 1300 include a raised grip 1140, 1340 that is disposed at the end of the base panel 1110, 1310, respectively. The raised grip 1140, 1340 can be formed in a manner similar to the ribs 1135, 1335. The size and shape of the raised grip 1140, 1340 is an ergonomic design decision, such that the raised grip 1140, 1340 facilitates access by the intended user. For example, the slide card 1100, 1300 can be captured between a user's thumb and finger, wherein the user's thumb contacts the convex surface and the user's finger contacts the opposite concave surface. In the embodiments shown in FIGS. 6 and 7, the raised grip 1140, 1340 is integral to the rib 1135, 1335. However, in alternative embodiments, the raised grip 1140, 1340 may be detached or offset from the rib 1135, 1335 or the rib 1135, 1335 may be omitted.

Figure 8:
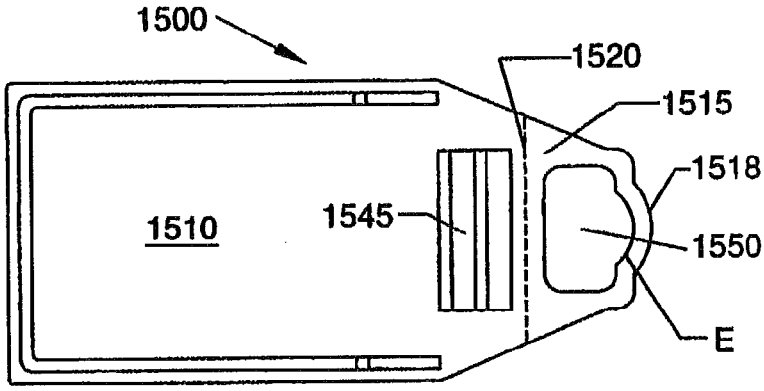
FIG. 8 is a plan view of an exemplary embodiment of a slide card, according to the present invention.
Figure 9:
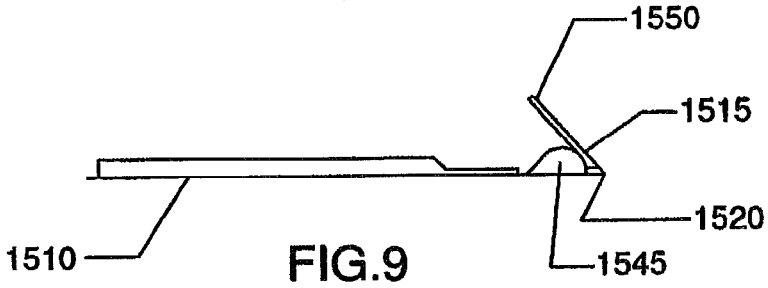
FIG. 9 is a side elevation view of the exemplary slide card of FIG. 8.

Referring now to FIGS. 8 and 9, the ability of the locking panel 1515 of a slide card 1500 to be engaged by an aperture or panel that forms a part of the locking arrangement of the system's sleeve or shell (not shown), is enhanced by biasing the locking panel 1515 away from a substantially parallel condition with respect to the base panel 1510. Fold-resisting features serve this purpose. The hinge 1520 serves as a fold-resisting mechanism to bias the locking panel 1515. The amount of bias in the hinge 1520 may be controlled by additional manufacturing techniques including varying the thickness of the hinge 1520 or otherwise varying the degree to which a line forming the hinge 1520 is weakened to permit bending.

The base and locking panels 1510, 1515 of the slide card 1500 further include fold-resisting abutments 1545, 1550 that prevent the locking panel 1515 and base panel 1510 from being placed into a substantially parallel condition or face contacting arrangement with respect to one another. Although one fold-resisting abutment on either the locking panel 1515 or the base panel 1510 is sufficient to serve as a fold-resisting mechanism or element, more than one fold-resisting abutment may be used on either one or both panels 1510, 1515. The use of opposing fold-resisting abutments 1545, 1550 on respective base 1510 and locking 1515 panels, provides the advantage of being able to minimize the height of each fold-resisting abutment 1545, 1550 while still achieving desirable fold resistance. Although each abutment may take many forms, an embossed abutment may be easily manufactured in a suitable substrate, particularly a substrate formed of plastic, paper, or a combination thereof, or other suitable materials.

The illustrated fold-resisting abutments 1545, 1550 are proximate to the hinge 1520. Specifically, the fold-resisting abutment 1545 is disposed on the base panel 1510 and the fold-resisting abutment 1550 is disposed on the locking panel 1515 such that, when the locking panel 1515 is folded along the hinge 1520, the fold-resisting abutments 1545, 1550 contact one another to provide support to the hinge 1520 or otherwise maintain the proper locking angle of the locking panel 1515. In the exemplary embodiment, the fold-resisting abutment 1545 has a shape similar to a bubble or otherwise has a substantially semi-circular cross section. The fold-resisting abutment 1550 has a substantially rectangular cross section. It is noted that, in alternative embodiments, the fold-resisting abutments may have any size or shape that facilitates supporting the locking panel and hinge.

The fold-resisting abutment 1550 shown in FIG. 8 includes a curved edge E that is proximal to the engaging edge 1518. The edge E of the fold-resisting abutment 1550 is curved such that the locking panel 1515 resists buckling along the engaging edge 1525. In addition, the fold-resisting abutment 1550 increases the rigidity of the locking panel 1515 to resist bending over the fold-resisting abutment 1545. In other words, the locking panel 1515 may tend to fold at the edge E where the support of the fold-resisting abutment 1550 ends. The curvature of the curved edge E also resists the tendency of the locking panel 1515 to fold along a straight line and thus resists the undesired possibility of collapsing. With reference now to FIG. 9, a side elevation view of the slide card 1500 is shown. The locking panel 1515 is shown partially pivoted about the hinge 1520 with respect to the base panel 1510 to a position wherein it can engage one or more locking elements in a sleeve or shell to help form a locking arrangement.

Figure 10:
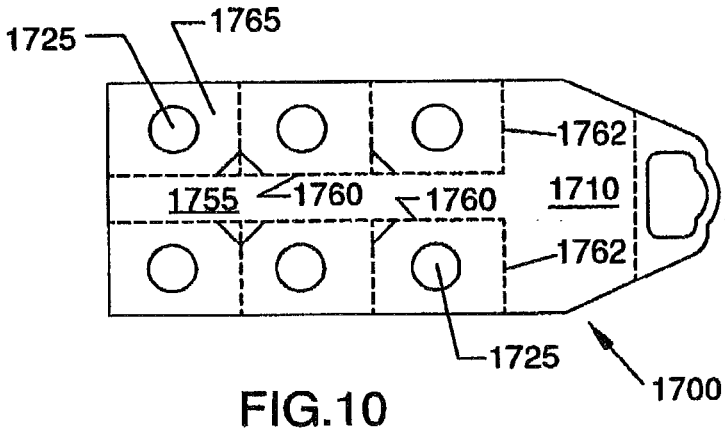
FIG. 10 is a plan view of an exemplary embodiment of a slide card, according to the present invention.

Turning now to FIG. 10, a slide card 1700 includes a center bar 1755 defined by longitudinal and transverse lines of demarcation. Transverse lines of demarcation 1762 extend from the longitudinal lines of demarcation 1760 to define tear-away units 1765. Each tear away unit 1765 is defined from a portion of the base panel 1710 and includes a blister 1725. The center bar 1755 permits continued access to and use of the slide card 1700 within a sleeve as units 1765 are detached from the base panel 1710. In the exemplary embodiment, the center bar 1755 is located in the center of the base panel 1710. However, in alternative embodiments, the bar may be located in any suitable position. For example, the bar may be located adjacent to a longitudinal edge of the slide card 1700.

Figure 11:
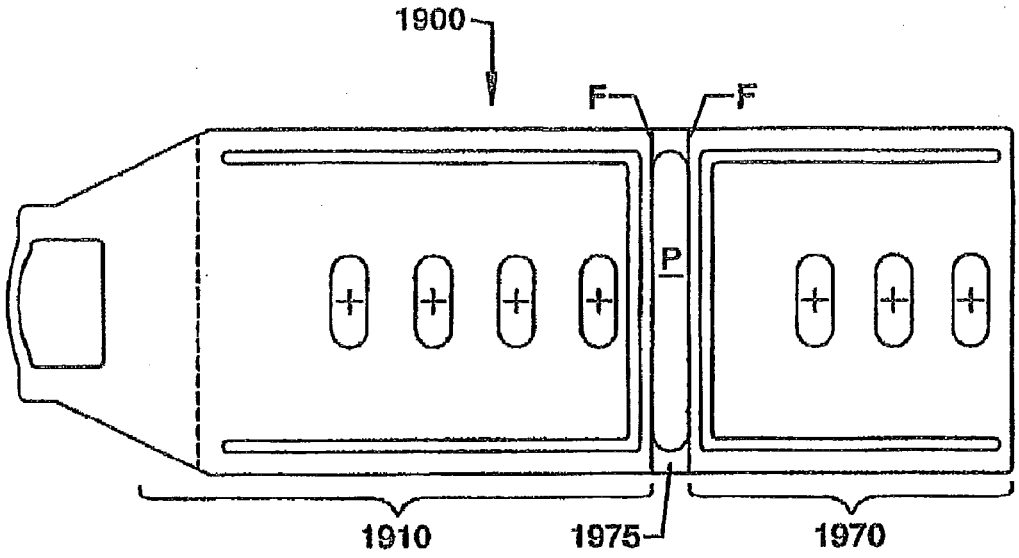
FIG. 11 is a plan view of an exemplary embodiment of a slide card, according to the present invention.
Figure 12:
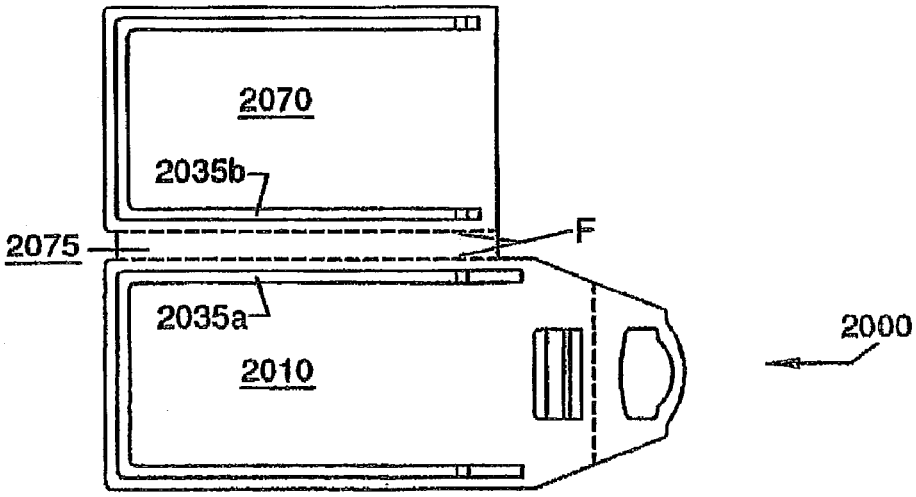
FIG. 12 is a plan view of an exemplary embodiment of a slide card, according to the present invention.
Figure 13:
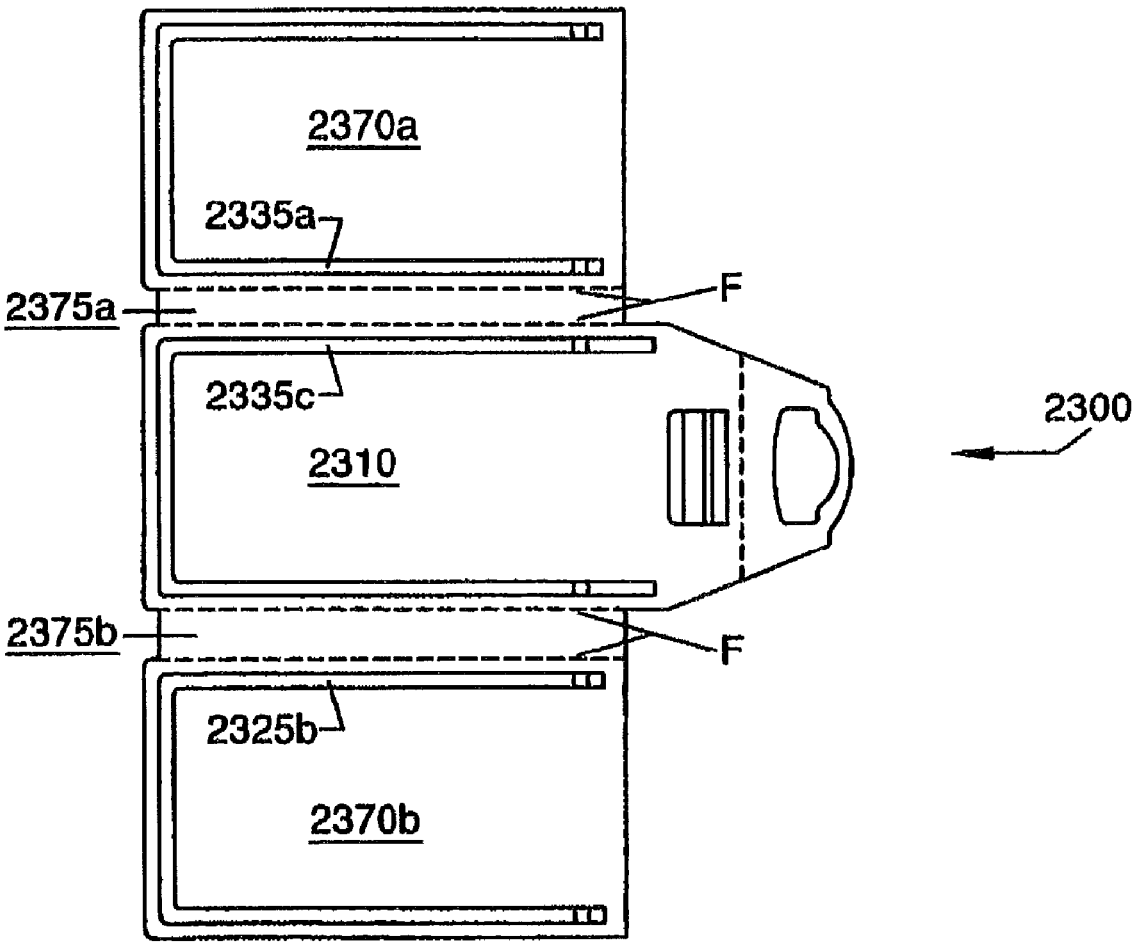
FIG. 13 is a plan view of an exemplary embodiment of a slide card, according to the present invention.

Referring to FIGS. 11-13, embodiments of a slide card including a fold-over panel are shown. Beginning with FIG. 11, a slide card 1900 includes a fold-over panel 1970. The fold-over panel 1970 is connected to the base panel 1910 by a hinge panel 1975. Specifically, the hinge panel 1975 is hingedly connected to the panels 1910, 1970 along fold lines F. In this embodiment, the hinge panel 1975 includes an aperture P. The aperture P reduces the stress at the hinge panel 1975. It is contemplated that a hinge may be defined by one or more apertures P and that the fold lines F may be omitted. The apertures P may be any suitable size or shape that facilitates reducing stress in a portion of the slide card between the base panel and the fold-over panel. It is further contemplated that the aperture P may be omitted and the fold lines may extend across the slide card to define a hinge panel. In alternative embodiments, it is contemplated that formed hinges or soft creasing may be used as a hinge.

Figure 12A:
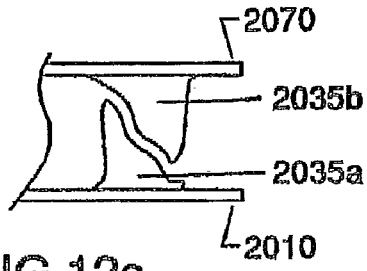
FIG. 12*a* is a cross-section elevation view of the ribs of exemplary folded cards, of FIG. 12.

With regard to FIGS. 12 and 12*a*, a slide card 2000 includes a fold-over panel 2070 connected to the base panel 2010 by a hinge panel 2075. Specifically, the hinge panel is connected to the panels 2010, 2070 along fold lines F. The base panel 2010 and the fold-over panel 2070 include U-shaped ribs 2035*a*, 2035*b*, respectively. The U-shaped ribs 2035*a*, 2035*b* correspond to one another such that, as the fold-over panel 2070 is folded to be substantially parallel to the base panel 2010, the ribs 2035*a* on the base panel 2010 align and are in contact with the ribs 2035*b* on the fold-over panel 2070. Specifically, the ribs 2035*a*, 2035*b* are substantially similar in shape and are positioned substantially symmetrically about the hinge panel 2075. As shown in FIG. 12*a*, the ribs 2035*a*, 2035*b* can be designed to matingly engage such that the slide card 2000 is maintained in the folded arrangement described above. The design of the ribs 2035*a*, 2035*b* is not limited to that shown in FIG. 12*a*, but include any corresponding cross-sections that facilitate maintaining the folded arrangement. For example, the cross-sections may be a protrusion and recess combination or each of the cross-sections may be defined by a common diagonal plane. In yet other embodiments, either set of ribs are wider and longer in order to receive the other set. In that configuration, the ribs are nested and the folded panels achieve a thinner profile.

With reference to FIG. 13, a slide card 2300 includes multiple fold-over panels 2370*a*, 2370*b* connected to the base panel 2310 by hinge panels 2375*a*, 2375*b*, respectively. Specifically, the hinge panels 2375*a*, 2375*b* are connected to the base panel 2310 and to a respective fold-over panel 2370*a*, 2370*b* along the fold lines F. In the exemplary embodiment, the hinge panel 2375*b* is wider than the hinge panel 2375*a* such that the fold-over panel 2370*a* can be folded onto the base panel 2310, as described above, and the fold-over panel 2370*b* can subsequently be folded onto the fold-over panel 2370*a*. Thereby, the ribs 2335*a* of the fold-over panel 2370*a* are in contact with the ribs 2335*c* of the base panel 2010, and the ribs 2335*b* of the fold-over panel 2370*b* are in contact with the outside surface of the fold-over panel 2370*a*.

Alternative embodiments of the present invention include a slide card having a peelable backing, not shown. The peelable backing facilitates removal of items and can include foil or a combination of foil and tissue or kraft paper, and is sealed to the back of the blister. Frangible lines, such as perforated, cut, or score lines, are added to the peelable backing to define tabs which are peelable to expose the article within a blister. In this embodiment, a peel initiation area is located along the edge or perimeter of the slide card. In alternative embodiments, wherein a more child resistant peelable backing is desired, a peel initiation area may be located toward the center of the slide card. Advantageously, the slide card includes a stationary body member that may be engaged to grip the slide card before or after the tabs have been peeled away. It should be noted that the peelable backing can be incorporated into alternative embodiments, such as shown in FIG. 10. In that case, the center bar 1755 is, in effect, a stationary body member and, when a tear away unit 1765 is removed a small angled cut line defines the peel initiation location of a peelable backing.

It must be emphasized that the law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A packaging system comprising:

a releasably lockable sleeve including a catch flap disposed at an open end of the sleeve; and an insert card slidably received in the sleeve for movement between a first position where the insert card is fully received in the sleeve and a second position where the insert card is nearly removed from the sleeve, said insert card comprising:

a monolithically formed base panel defined by opposing edges spaced apart by opposing ends the opposing edges extending along a length of the insert card;

a folded locking panel connected to the base panel such that the folded locking panel engages with the catch flap when the insert card is in the second position whereby the insert card is prevented from being fully removed from the sleeve; and at least one blister integrally formed within said base panel to define the perimeter of a blister opening within said base panel, said blister configured to receive an item through said blister opening, wherein said base panel comprises a first rib disposed such that the first rib is in engagement with the catch flap to prevent said at least one blister from engaging the catch flap when said insert card is in the first position.

2. The packaging system of claim 1 wherein said base panel includes an abutment for inhibiting a face-contacting relationship between said base panel and said locking panel, said abutment being spaced apart from said at least one blister.

3. The packaging system of claim 1, wherein said locking panel is hingedly attached to said base panel along at least a portion of one of said opposing ends of said base panel, and said first rib extends from a first end thereof adjacent to said one of said opposing ends of said base panel toward the other of said opposed ends of said base panel.

4. The packaging system of claim 3, wherein said first rib extends from said first end to a second end thereof adjacent to said other of said opposing ends of said base panel, and said base panel further includes a second rib connected to said first rib at said second end of said first rib.

5. The packaging system of claim 4, wherein said second rib extends along said other of said opposed ends of said base panel.

6. The packaging system of claim 5, wherein said first rib extends along one of said opposing edges of said base panel.

7. The packaging system of claim 6, wherein said second rib extends from said second end of said first rib to a terminal end of said second rib adjacent to the other of said opposed edges of said base panel, and said base panel further includes a third rib connected to said second rib at said terminal end of said second rib.

8. The packaging system of claim 7, wherein said third rib extends along said other of said opposed edges of said base panel.

9. The packaging system of claim 8, wherein said third rib extends from said terminal end of said second rib toward said locking panel.

10. The packaging system of claim 8, wherein said third rib has a height that is no less than the height of said at least one blister.

11. The packaging system of claim 3, wherein said locking panel includes an abutment for inhibiting a face-contacting relationship between said base panel and said locking panel, said abutment being spaced apart from a free end edge of said locking panel, opposite a hinged connection between said locking panel and said base panel.

12. The packaging system of claim 1, wherein the first rib extends along the length of the insert card such that the first rib is in engagement with the catch flap to prevent said at least one blister from engaging the catch flap when said insert card is disposed between the first and second positions.

13. A packaging system comprising:

a lockable sleeve having a catch flap; and an insert card slidably received in said lockable sleeve for movement between a fully received position and a fully extended position where the insert card is nearly removed from the lockable sleeve, said insert card comprising:

a base panel having first and second sides and defined by opposing edges spaced apart by opposing ends;

at least one locking panel hingedly attached to said base panel and disposed in engagement with said catch flap to prevent said insert card from being fully removed from said lockable sleeve when the insert card is in the fully extended position; and at least one blister integrally formed within said base panel to define the perimeter of a blister opening within said base panel, said blister protruding from said first side of said base panel, wherein said base panel comprises a first rib protruding from the first side of the base panel such that the first rib is in engagement with the catch flap to prevent said at least one blister from engaging said catch flap when said insert card is in the fully received position.

14. The packaging system of claim 13, wherein said lockable sleeve has a wall to which said catch flap is hingedly connected, and said insert card is inserted into said lockable sleeve such that said first side of said base panel is disposed adjacent to said wall of said lockable sleeve.

15. The packaging system of claim 13, wherein the first rib extends substantially parallel to the opposing edges of the base panel such that the first rib is in engagement with the catch flap to prevent said at least one blister from engaging the catch flap when said insert card is disposed between the fully received position and the fully extended position.

16. The packaging system of claim 15, wherein said locking panel is hingedly attached to said base panel along at least a portion of one of said opposing ends of said base panel.

17. The packaging system of claim 16, wherein said catch flap is hingedly connected to a wall of said lockable sleeve.

18. The packaging system of claim 17, wherein said base panel has first and second opposed sides, said at least one blister protrudes from said first side of said base panel, and said insert card is inserted into said lockable sleeve such that said first side of said base panel is adjacent to said wall of said lockable sleeve.

19. The packaging system of claim 15, wherein said first rib extends substantially parallel to said opposing edges of said base panel.

20. The packaging system of claim 15, wherein said first rib has a height that is no less than the height of said at least one blister.

* * * * *